299-13 SR
5/6/80 XR 4,201,419

United States Patent [19] [11] 4,201,419
Hutchins [45] May 6, 1980

[54] CONTROL OF AIRBLAST DURING EXPLOSIVE EXPANSION IN AN IN SITU OIL SHALE RETORT

[75] Inventor: Ned M. Hutchins, Grand Junction, Colo.

[73] Assignee: Occidental Oil Shale, Inc., Grand Junction, Colo.

[21] Appl. No.: 935,506

[22] Filed: Aug. 21, 1978

[51] Int. Cl.[2] ..... E21C 41/10
[52] U.S. Cl. ..... 299/2; 299/13
[58] Field of Search ..... 299/2, 13; 166/259, 166/299; 102/23, 30

[56] References Cited

U.S. PATENT DOCUMENTS

| | | | |
|---|---|---|---|
| 473,734 | 4/1892 | Forrester | 299/13 |
| 3,397,756 | 8/1968 | Andrews et al. | 102/23 X |
| 4,043,595 | 8/1975 | French | 299/2 |
| 4,118,071 | 10/1978 | Hutchins | 299/2 |

*Primary Examiner*—Ernest R. Purser
*Attorney, Agent, or Firm*—Christie, Parker & Hale

[57] ABSTRACT

An in situ oil shale retort is formed in a subterranean formation containing oil shale. Underground workings excavated within the formation provide a means for access to a retort site in the formation. At least one void is excavated in the retort site via access provided by the underground workings, leaving a remaining portion of the unfragmented formation within the retort site adjacent the void. Explosive placed in the remaining unfragmented formation adjacent such a void is detonated in a single round for explosively expanding the unfragmented formation toward such a void for forming a fragmented permeable mass of formation particles containing oil shale. Prior to such explosive expansion, a barrier of unfragmented formation is left between such a void and underground workings providing means for access to such a void. At least one gas flow passage extends through the barrier of unfragmented formation between the means for access and the retort site. Such a gas flow passage has a substantially smaller cross-section for gas flow than the transverse cross-section of the means for access to the retort site. The smaller cross-section of such a gas flow passage temporarily confines the high gas pressure generated by the explosion and limits the flow of gas to the means for access for attenuating airblast in the means for access and other underground workings in gas communication with the means for access.

21 Claims, 5 Drawing Figures

CONTROL OF AIRBLAST DURING EXPLOSIVE EXPANSION IN AN IN SITU OIL SHALE RETORT

BACKGROUND OF THE INVENTION

This invention relates to in situ recovery of shale oil, and more particularly, to techniques for attentuating airblast produced when detonating large amounts of explosive for forming an in situ oil shale retort.

The presence of large deposits of oil shale in the Rocky Mountain region of the United States has given rise to extensive efforts to develop methods for recovering shale oil from kerogen in the oil shale deposits. It should be noted that the term "oil shale" as used in the industry is in fact a misnomer; it is neither shale, nor does it contain oil. It is a sedimentary formation comprising marlstone deposit with layers containing an organic polymer called "kerogen", which upon heating, decomposes to produce liquid and gaseous products. It is the formation containing kerogen that is called "oil shale" herein, and the liquid hydrocarbon product is called "shale oil."

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits has been described in several patents, such as U.S. Pat. Nos. 3,661,423; 4,043,595; 4,043,596; 4,043,597; and 4,043,598, which are incorporated herein by this reference. These patents describe in situ recovery of liquid and gaseous hydrocarbon materials from a subterranean formation containing oil shale, wherein such formation is explosively expanded to form a stationary, fragmented permeable body or mass of formation particles containing oil shale within the formation, referred to herein as an in situ oil shale retort. Retorting gases are passed through the fragmented mass to convert kerogen contained in the oil shale to liquid and gaseous products of retorting. One method of supplying hot retorting gases used for converting kerogen contained in the oil shale, as described in U.S. Pat. No. 3,661,423, includes establishing a combustion zone in the retort and introducing an oxygen supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat oil shale in a retorting zone to a temperature sufficient to produce kerogen decomposition, called "retorting." Such decomposition in the oil shale produces gaseous and liquid products, including gaseous and liquid hydrocarbon products, and a residual solid carbonaceous material.

The liquid products and the gaseous products are cooled by the cooled oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition, and any gaseous retort inlet mixture that does not take part in the combustion process. The products of retorting are referred to herein as liquid and gaseous products.

U.S. Pat. No. 4,043,595, and 4,043,596 disclose methods for explosively expanding formation containing oil shale to form an in situ oil shale retort. According to methods disclosed in those patents, formation is excavated to form a columnar void bounded by unfragmented formation having a vertically extending free face, drilling blast holes adjacent the columnar void and parallel to the free face, loading the blast holes with explosive, and detonating the explosive in a single round. This explosively expands the formation adjacent the columnar void toward the free face for forming a fragmented permeable mass of formation particles containing oil shale in an in situ oil shale retort. In one embodiment, the columnar void is a slot having large, parallel, planar vertical free faces toward which the formation in the retort site can be explosively expanded. The blast holes are arranged in planes parallel to such free faces. An embodiment of such a method is described in my copending U.S. patent application Ser. No. 790,350, filed Apr. 25, 1977, now U.S. Pat. No. 4,118,071 which is incorporated herein by this reference.

Explosive in such blast holes is detonated in a time-delay sequence for explosively expanding unfragmented formation within the retort site in a single round of a plurality of explosions. The sequence of blasting is rapid, and in an embodiment disclosed in U.S. Pat. No. 4,118,071, time-delays for explosively expanding formation toward the columnar void span a time period of less than 200 milliseconds. Shorter time delays can be used in other embodiments. In one embodiment, as much as 85 tons of explosive are detonated in a single round of explosions for explosively expanding formation toward a columnar void. This produces a powerful explosion which generates a large volume of gas within the retort site. At least a portion of the gas must escape from the mine workings, and since high pressures are present in the vicinity of the blast, very high flow velocities can occur in the mine workings. This is known as airblast which can travel through underground workings leading away from the blast site. Airblast from such a powerful explosion can cause serious damage to equipment and injury to personnel in such underground workings. Equipment which can be damaged from such airblast cannot necessarily be easily or economically removed from underground workings prior to such explosive expansion and then returned after blasting. Thus, there is a need to attentuate airblast produced when detonating large amounts of explosive for forming an in situ oil shale retort for reducing effects of such airblast in the mine workings adjacent the blast site.

SUMMARY OF THE INVENTION

A method is provided for attenuating airblast in underground workings produced by detonating explosive in a subterranean formation containing oil shale when forming an in situ oil shale retort. Underground workings are excavated for providing a means for access to a retort site in the formation containing oil shale, and at least one void is excavated in formation within the retort site, leaving a remaining portion of unfragmented formation within the retort site adjacent such a void. A barrier of unfragmented formation is left between the void and underground workings providing a means for access to the retort site. A gas flow passage extends through the barrier of unfragmented formation between the means for access and the retort site. The gas flow passage has a substantially smaller cross-section for gas flow than the transverse cross-section of the means for access. Explosive is placed in the remaining unfragmented formation adjacent such void, and such explosive is detonated for explosively expanding the unfragmented formation toward such a void for forming a fragmented permeable mass of formation particles containing oil shale. The smaller cross-section of the gas flow passage confines gas from such explosive expansion and limits flow of such gas to such means for access to attenuate airblast in the underground workings.

DRAWINGS

Features of specific embodiments of the best mode contemplated for carrying out the invention are illustrated in the drawings in which FIG. 1 is a fragmentary, semi-schematic vertical cross-sectional side view taken on line 1—1 of FIG. 2 and showing an in situ oil shale retort having a gas flow passage in a barrier of unfragmented formation between a retort site and an upper base of operation for attenuating airblast according to principles of this invention;

DETAILED DESCRIPTION

Figure 1:
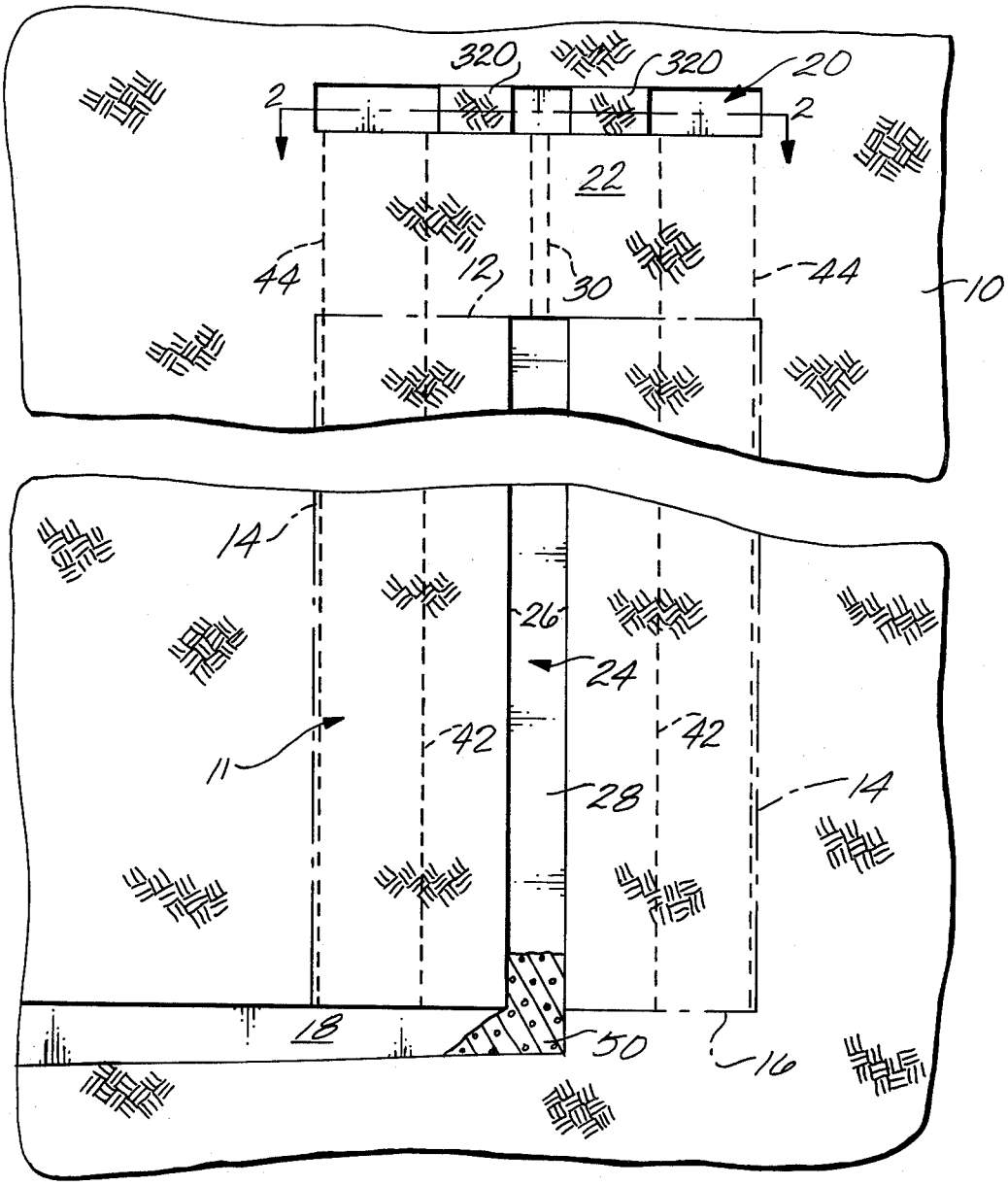

FIG. 1 shows a subterranean formation 10 containing oil shale in which an in situ oil shale retort is being formed in a retort site 11 within the formation. The in situ retort being formed is rectangular in horizontal cross-section, and as shown in phantom lines in FIG. 1, the retort being formed has a top boundary 12, four vertically extending side boundaries 14, and a lower boundary 16. A drift 18 at a production level provides a means for access to the lower boundary of the in situ oil shale retort. Formation excavated to form the drift 18 is transported to above ground through an adit or shaft (not shown).

The in situ oil shale retort is formed by excavating a portion of the formation to form an open base of operation 20 on an upper working level. The floor of the base of operation 20 is spaced above the upper boundary 12 of the retort being formed, leaving a horizontal sill pillar 22 of unfragmented formation between the bottom of the base of operation and the upper boundary 12 of the retort being formed. The horizontal extent of the base of operation 20 is sufficient to provide effective access to substantially the entire horizontal cross-section of the retort site. Such a base of operation 20 provides an upper level means for access for excavation operations for forming a void within the retort site. The base of operation also provides means for access for explosive loading for explosive expansion of formation toward such a void to form a fragmented permeable mass of formation particles in the retort being formed. The base of operation also facilitates introduction of oxygen supplying gas into the top of the retort formed below the horizontal sill pillar 22.

In the working embodiment illustrated in the drawings, the base of operation 20 has a central drift 120 (see FIG. 2) and a separate side drift 220 on each side of the central drift 120. The two side drifts are similar to each other. Elongated roof supporting pillars 320 of unfragmented formation separate the side drifts from the central drift. Short cross cuts 420 interconnect the side drifts and the central drift to form a generally E-shaped excavation. Other arrays of drifts and roof supporting pillars can be used. A branch drift 21 provides a means for access to the base of operation 20 from underground workings at the level of the base of operation. The branch drift 21 can provide a means for access between the upper base of operation and underground workings leading to daylight.

Figure 2:
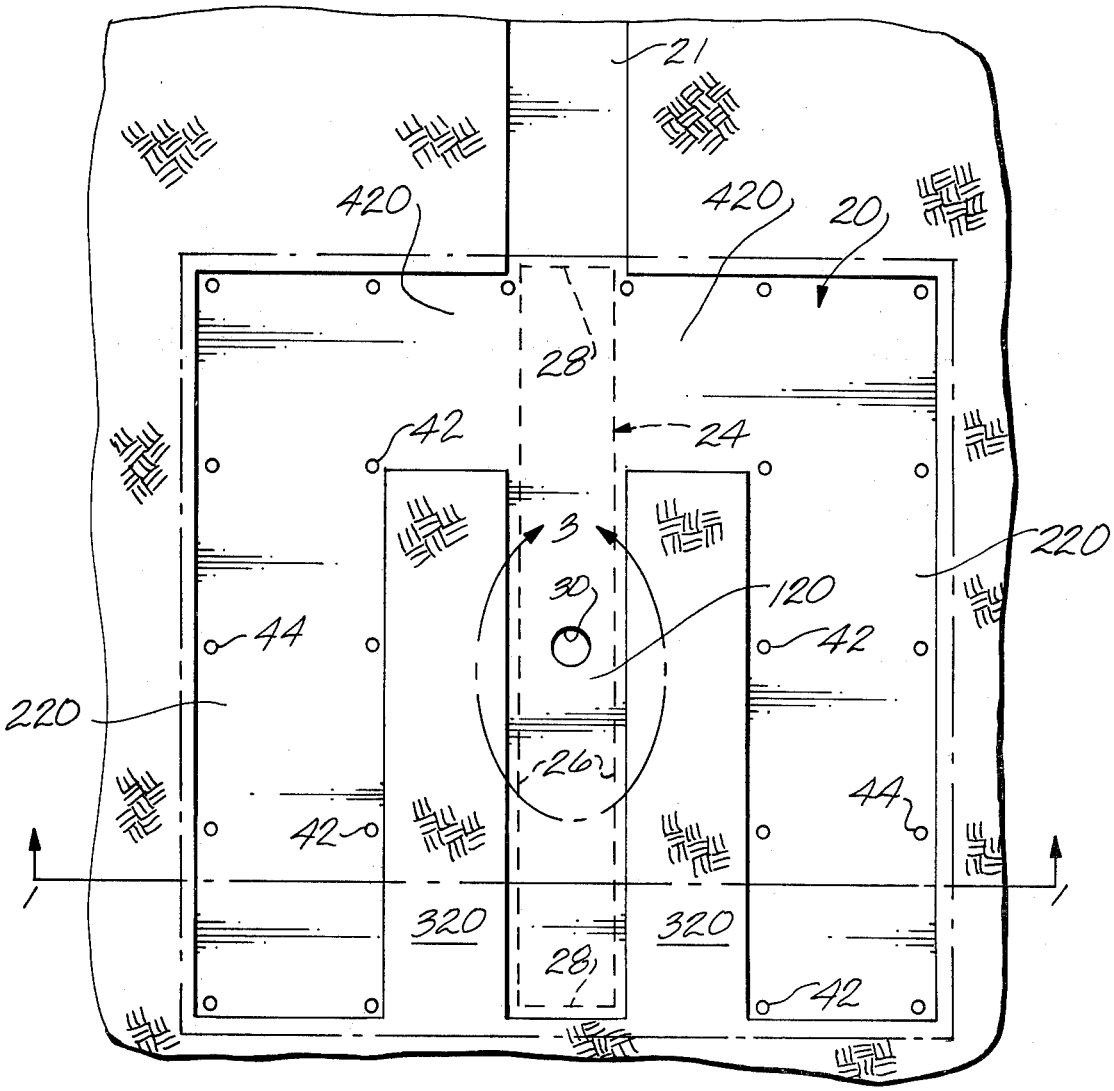
FIG. 2 is a fragmentary, semi-schematic cross-sectional plan view taken on line 2—2 of FIG. 1 and showing the base of operation and the gas flow passage.

The in situ oil shale retort is prepared by excavating a portion of formation within the retort site to form at least one columnar void. In the working embodiment illustrated in the drawings, the columnar void is in the form of a narrow, elongated vertical slot-shaped void 24, herein referred to as a vertical slot. In the working embodiment, one such vertical slot is shown in the center of the rectangular retort being formed, although more than one vertical slot can be formed within the retort site, if desired. The vertical slot extends between the production level drift 18 and the top boundary 12 of the retort being formed. The side walls 26 of unfragmented formation adjacent the slot provide a pair of laterally spaced apart, parallel free faces extending vertically through the retort site. The length of the slot extends essentially the entire distance between opposite side boundaries 14 of the retort being formed, forming end walls 28 of the slot adjacent the side boundaries of the retort site. The slot is formed essentially in the center of the horizontal cross-section of the retort being formed. The length and width of the slot are best illustrated in FIG. 2. In an embodiment such as that shown in FIG. 2, the slot is about 120 feet in length and about 20 feet wide, and over about 250 feet in height. Techniques for forming the slot are described in U.S. Pat. No. 4,118,071.

The vertical slot 24 is formed by first excavating formation within the retort site for forming a raise within the volume of formation to become the slot. A balance of unfragmented formation is left within the volume to become the slot between the raise and at least one of the shorter faces, i.e., the end walls 28 of the slot. The balance of unfragmented formation within the volume to become the slot is explosively expanded toward the raise.

Figure 3:
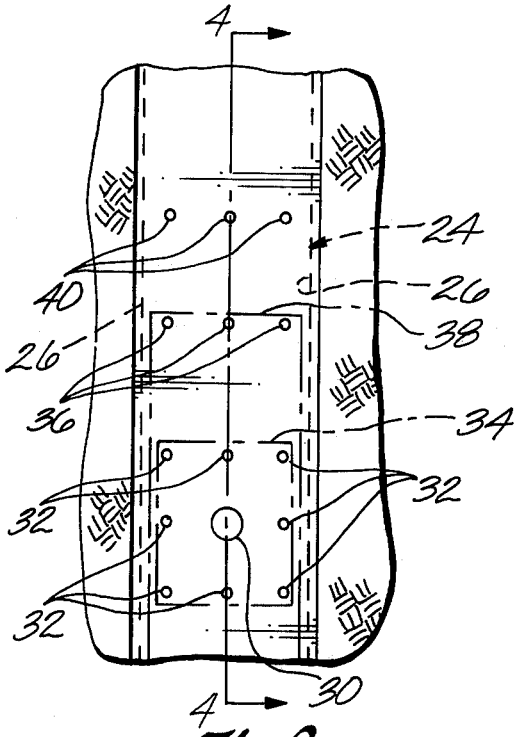
FIG. 3 is an enlarged fragmentary, semi-schematic cross-sectional plan view showing a portion of the base of operation within the circle 3 of FIG. 2.

In the working embodiment shown in the drawings, the slot 24 is formed by initially drilling and boring a 4-foot diameter circular raise 30 between the floor of the base of operation 20 and the lower level access drift 18. As shown in FIGS. 2 and 3, the raise 30 is bored at the center of the slot 24 being formed. Rows of first blast holes 32 (see FIG. 3) are drilled downwardly from the base of operation on opposite sides of the raise. The first blast holes 32 extend from the base of operation to the lower access drift 18. In the working embodiment, the first blast holes are 3⅝ inches in diameter, and these blast holes are illustrated somewhat larger than actual scale in FIG. 3 for clarity. The first blast holes 32 are loaded with explosive from the level of either the lower access drift or lower boundary 16 up to a level corresponding to the top boundary 12 of the retort being formed. Upon portions of the first blast holes 32 which extend through the sill pillar 22 are stemmed with an inert material such as gravel to inhibit breakage above the top boundary of the slot being formed. Explosive in the first blast holes 32 is detonated to explosively expand formation toward the free face provided by the raise 30 to lengthen the raise (in a horizontal direction) to a longer first rectangular raise 34 illustrated in phantom lines in FIG. 3. The resulting formation particles are excavated from the lower level drift 18.

Following formation of the first rectangular raise 34, a set of second blast holes 36 is drilled parallel to and spaced from the first rectangular raise, the second blast holes 36 are loaded with explosive and detonated to enlarge the first rectangular raise to a longer second rectangular raise 38 illustrated in FIG. 3. The second rectangular raise 38 is enlarged by drilling a set of third blast holes 40 in unfragmented formation parallel to and adjacent the outside of the second raise 38 and by detonating explosive in such blast holes to lengthen the second rectangular raise to a further extent. The drilling and blasting sequences are repeated until the length of the slot is enlarged to essentially the full width of the retort being formed.

Following formation of the vertical slot 24, a plurality of mutually spaced apart blast holes are drilled downwardly from the base of operation 20 through unfragmented formation remaining within the retort site 11 on opposite sides of the slot. The blast holes extend between the floor of the base of operation to the lower boundary 16 of the retort being formed. The blast holes can be arranged as shown in FIG. 2, wherein five blast holes each about ten inches in diameter are in each of two rows parallel to each of the large side walls 26 of the slot 24. The pattern of ten blast holes on one side of the slot is similar to the pattern on the other side of the slot. A separate inner row of five blast holes 42 is drilled alongside each roof supporting pillar 320 on the opposite side thereof from the central drift 120 of the base of operation. A separate outer row of five blast holes 44 is drilled downwardly from the outside of each side drift in the base of operation along each side boundary 14 of the retort being formed. The twenty blast holes drilled down from the base of operation are loaded with explosive up to a level corresponding to the top boundary of the retort being formed. Upper portions of the blast holes extending through the sill pillar are stemmed to inhibit breakage of formation above the top boundary of the retort being formed. Explosive in these blasting holes is detonated to explosively expand formation remaining within the retort site toward the vertical free faces of formation adjacent the slot 24. This forms a fragmented permeable mass 46 (see FIG. 5) of formation particles containing oil shale within the boundaries of the retort site.

Formation within the retort site is explosively expanded toward the slot in a single round of explosions, which produces a powerful explosion. In the working embodiment shown in the drawings, formation on each side of the slot is explosively expanded toward the slot to form a fragmented mass about 120 feet square and 250 feet high. In an experimental retort similar to that shown in the drawings, approximately 85 tons of explosive was used for explosively expanding formation toward such a vertical slot. Although explosive was distributed in 20 blast holes similar to that shown in the drawings, and short time delays were present between sequential blast holes, all of the explosive was detonated in a single round. When such explosive is detonated, it transforms much of its mass from the liquid or solid state to a gaseous state. A large volume of high temperature, high pressure gas is generated in a very short time interval. The resultant gas pressure provides a moving force for fragmenting formation. Gas from the explosion cools rapidly by contact with formation particles. The large volume of gas generated by such explosion should not be contained by an impermeable barrier, but should be allowed to dissipate by passage through underground workings, or the like. The escape of gas from the site of explosion can result in potentially damaging airblast to underground workings in gas communication with the retort site.

According to this invention, airblast is minimized in underground workings providing a means for access to the retort site. According to the invention, gas flow from the explosion is caused to pass through at least one gas flow restricting passage extending through a barrier of unfragmented formation adjacent the retort site before gas from the explosion passes to such means for access to the retort site. Such a gas flow passage has a cross-section for gas flow which is substantially smaller than the transverse cross-section of such means for access to the retort site. The reduced cross-section area for gas flow temporarily confines gas from the explosion and vents gas from the explosion to the means for access sufficiently slowly to attenuate airblast in the means for access.

Figure 4:
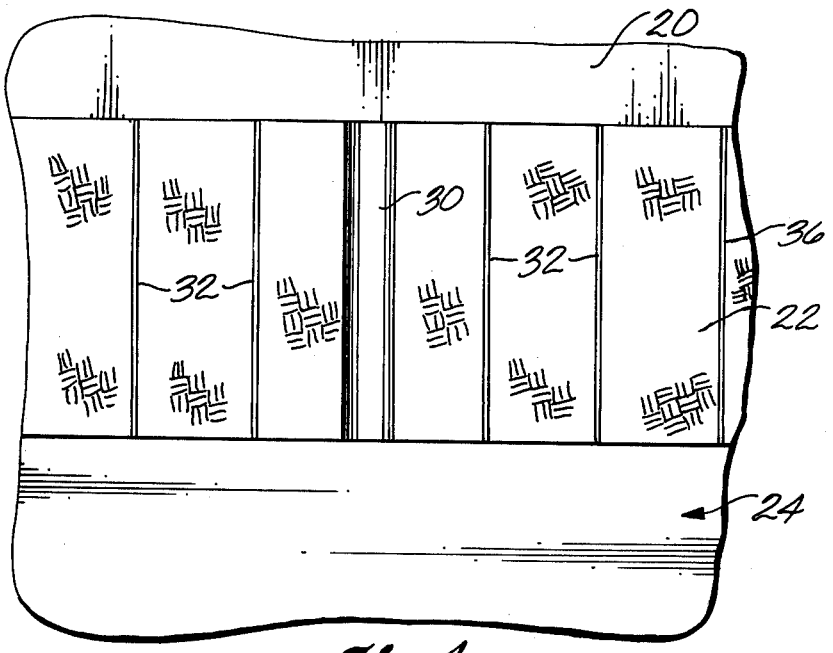
FIG. 4 is a fragmentary, semi-schematic vertical cross-sectional side view taken on line 4—4 of FIG. 3 and showing the gas flow passage between the base of operation and the retort site.

The gas flow restricting passage can be provided by the raise 30 which was used for commencing mining of the slot. The raise is left open during explosive expansion for forming the fragmented mass. As best illustrated in FIG. 4, such a raise provides a narrow, open-ended gas flow restricting passage through the entire depth of the barrier of unfragmented formation provided by the sill pillar 22 above the retort site 11. The raise is shown extending between the base of operation and the bottom of the barrier of unfragmented formation above the vertical slot. Alternatively, such a gas flow restricting passage can extend from the base of operation to a portion of the upper boundary 12 of the retort site away from the vertical slot. The raise has a transverse cross-sectional area substantially smaller than the cross-sectional area of the base of operation and of the access drift 21 connecting the base of operation with other underground workings. The gas flow passage also has a cross-section for gas flow which is substantially smaller than the horizontal cross-sectional area of the void (the portion of the void into which the gas flow passage opens). Owing to this reduced cross-section, the raise can reduce the effective transverse cross-sectional area for gas flow from the retort site to the base of operation and underground workings in gas communication with the base of operation.

The sill pillar provides a barrier of unfragmented formation overlying essentially all of the transverse cross-sectional area of the retort site, except for the 4-foot diameter raise 30 and the smaller blast holes 32, 36, etc. used in forming the vertical slot. The small blast holes were closed with small size gravel used as stemming when forming the vertical slot, so these holes will for the most part remain closed by the stemming when formation is explosively expanded for forming the fragmented mass 46. Alternatively, the smaller blast holes can be left open during explosive expansion. Upon explosive expansion of formation in the retort site, gas is vented from the retort site through the holes in the sill pillar. Some gas flow could occur through stemming remaining in the smaller blast holes; but at a rather low rate since most of the gas flows through the four-foot diameter raise 30. The much smaller area of the holes remaining open in the sill pillar as combined with the cross-section of the underground workings causes the holes, including the raise 30, to act as flow restricting orifices in confining gas from the explosion and venting gas from the explosion through the holes to the base of operation and adjacent underground workings. This limits the rate at which gas can enter underground workings on the upper working level, and minimizes airblast in the underground workings and similar means for access leading to the base of operation.

The reduced cross-section of the gas flow restricting passage between the blast site and underground workings on a side of the barrier opposite the blast site temporarily confines the high gas pressures generated by the explosion and gradually releases the pressure over a longer period of time than in the absence of such flow restriction. By so diffusing the gas flow, or spreading it over a period of time, airblast through the underground workings is attenuated.

Such a reduced cross-section for gas flow is provided in underground workings between the blast site and daylight. The means for access in which airblast is attenuated by such a gas flow passage are those which are open to the blast site and so that they would otherwise create a potential for injury to personnel or damage to equipment if airblast in such means for access were not attenuated. Such means for access can be drifts, adits, or other underground workings which are large enough to provide passage for men and equipment used for forming a void in a retort site toward which formation is explosively expanded when forming an in situ oil shale retort.

Airblast also is minimized in drifts on the lower production level. Following formation of the slot, a pile 50 of fragmented formation particles is left in the bottom of the slot. The pile of fragmented particles blocks the passage between the bottom of the slot and the production level drift 18. The pile of fragmented formation particles provides a permeable barrier for reducing the effective transverse cross-section of the drift sufficiently that potential airblast in lower level workings from detonating explosive within the retort site is attenuated by the flow of gas through the pile of fragmented formation particles. Such a method for attenuating airblast is described in U.S. application Ser. No. 840,856, filed Oct. 11, 1977, by Gordon B. French, now abandoned and assigned to the same assignee as this application, which application is incorporated herein by this reference.

The flow restricting passage through the sill pillar and the pile of fragmented formation particles 50 in the bottom of the slot together provide permeable barriers that are present between any portion of formation which is explosively expanded within the retort site and any underground workings which provide a means for access to formation being explosively expanded for forming the in situ retort.

Figure 5:
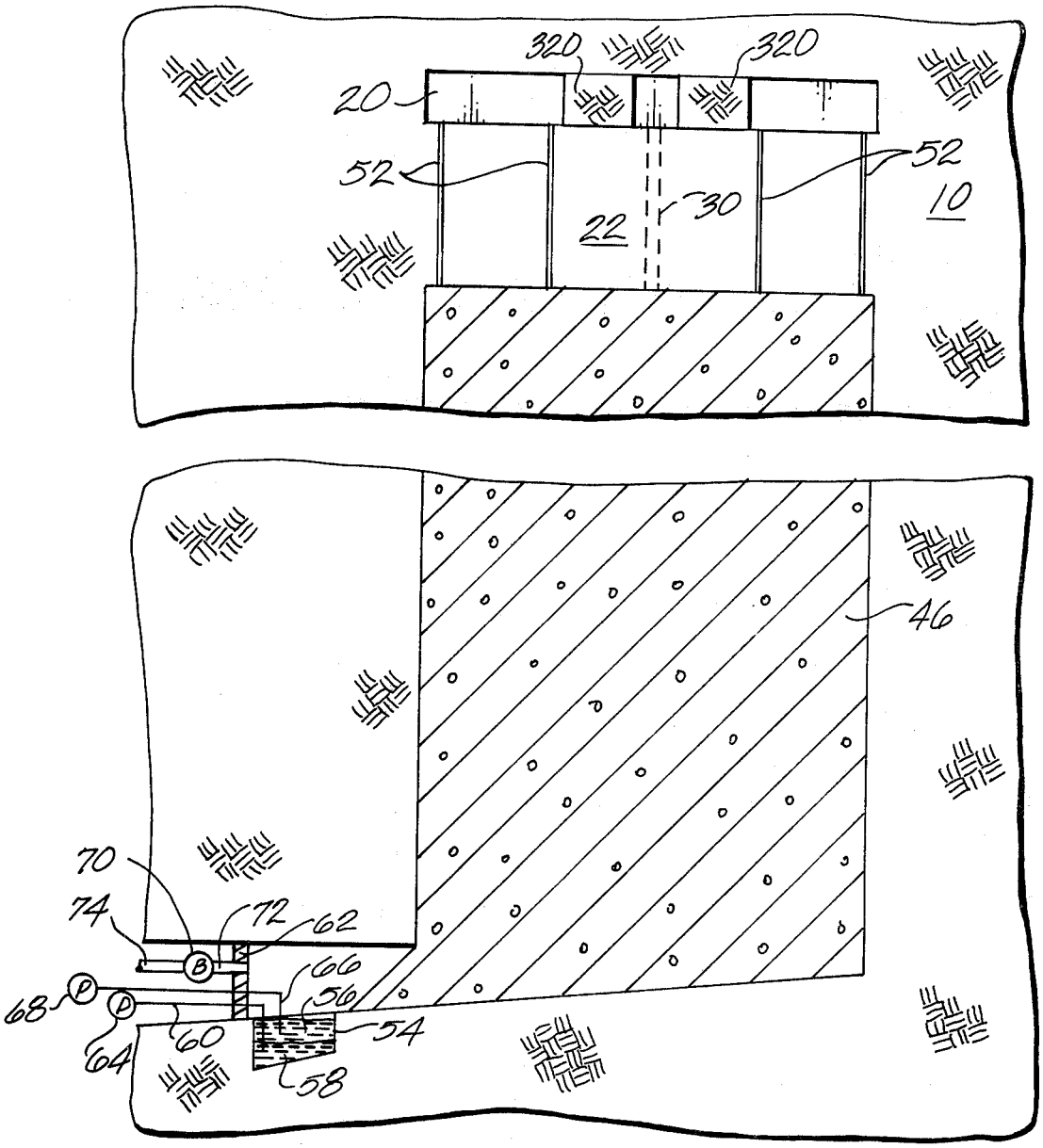
FIG. 5 is a fragmentary, semi-schematic vertical cross-sectional side view showing the in situ oil shale retort of FIG. 1 after explosive expansion of formation in the retort site.

FIG. 5 illustrates a completed in situ retort in which shale oil is produced from a fragmented mass 46. The particles at the top of the fragmented mass are ignited to establish a combustion zone at the top of the fragmented mass. Air or other oxygen supplying gas is supplied to the combustion zone from the base of operation 20 through conduits or passages 52 extending downwardly from the base of operation through the sill pillar to the top of the fragmented mass. The passages can be the upper ends of blast holes 42 and 44 extending through the sill pillar. Air or other oxygen supplying gas introduced to the fragmented mass through the conduits maintains the combustion zone and advances it downwardly through the fragmented mass. Hot gas from the combustion zone flows through the fragmented mass on the advancing side of the combustion zone to form a retorting zone where kerogen in the fragmented mass is converted to liquid and gaseous products. As the retorting zone moves down through the fragmented mass, liquid and gaseous products are released from the fragmented formation particles. A sump 54 in a portion of the production level drift 18 beyond the fragmented mass collects liquid products, namely, shale oil 56 and water 58, produced during operation of the retort. A water withdrawal line 60 extends from near the bottom of the sump out through a sealed opening (not shown) in a bulkhead 62 sealed across the access drift. The water withdrawal line is connected to a water pump 64. An oil withdrawal line 66 extends from an intermediate level in the sump out through a sealed opening (not shown) in the bulkhead and is connected to an oil pump 68. The oil and water pumps can be operated manually or by automatic controls (not shown) to remove shale oil and water separately from the sump. The inlet of a blower 70 is connected by a conduit 72 to an opening through the bulkhead for withdrawing off gas from the retort. The outlet of the blower delivers off gas from the retort through a conduit 74 to a recovery or disposal system (not shown).

What is claimed is:

1. A method for attenuating airblast produced by detonating explosive in a subterranean formation containing oil shale for forming a fragmented permeable mass of formation particles containing oil shale in an in situ oil shale retort, the method comprising the steps of:

excavating underground workings for providing a means for access to a retort site in the formation containing oil shale;

excavating at least one void in formation within the retort site, leaving a remaining portion of unfragmented formation within the retort site adjacent such a void, and leaving a barrier of unfragmented formation between the underground workings and the retort site;

providing at least one gas flow passage extending through the barrier of unfragmented formation between the underground workings and the retort site, the gas flow passage having a cross-section for gas flow which is substantially smaller than the transverse cross-section of the underground workings;

placing explosive in the remaining portion of unfragmented formation within the retort site adjacent such a void;

detonating the explosive for explosively expanding the portion of unfragmented formation toward such a void for forming a fragmented permeable mass of formation particles containing oil shale in an in situ oil shale retort; and venting at least a portion of the gas from such explosive expansion from the retort site through the gas flow passage toward the underground workings for limiting the rate of flow of such gas to the underground workings by means of the substantially smaller cross-section of the flow passage so as to attenuate airblast in the underground workings.

2. The method according to claim 1 including forming the gas flow passage with a cross-section for gas flow which is substantially smaller than the transverse cross-sectional area of underground workings providing a means for access between the retort site and daylight.

3. The method according to claim 2 including forming the gas flow passage with a cross-section for gas flow which is substantially smaller than the cross-sectional area of the void.

4. A method for attenuating airblast produced by detonating explosive in a subterranean formation containing oil shale for forming an in situ oil shale retort containing a fragmented permeable mass of formation particles containing oil shale, the method comprising the steps of:

excavating a means for access to an upper portion of a retort site within the formation containing oil shale;

excavating at least one columnar void within the retort site below the means for access, such a columnar void having a height similar to that of the retort being formed, leaving a remaining portion of unfragmented formation within the retort site adjacent such a void, and leaving a sill pillar of unfragmented formation between the means for access and such a void;

providing at least one gas flow passage through the sill pillar between the means for access and the top of the columnar void, the gas flow passage having a cross-section for gas flow which is substantially smaller than the transverse cross-section of the means for access and also smaller than the transverse cross-section of the void;

placing explosive in the remaining portion of unfragmented formation within the retort site; and explosively expanding such a portion of unfragmented formation toward the columnar void by detonating such explosive in a single round for forming an in situ oil shale retort containing a fragmented permeable mass of formation particles containing oil shale, such as gas flow passage having a sufficiently small cross-section for gas flow for temporarily confining gas from such explosive expansion and for venting gas from such explosive expansion to the means for access for attenuating airblast in such means for access.

5. The method according to claim 4 including forming the void, at least in part, via access provided by the gas flow passage, and leaving the gas flow passage open during the explosive expansion step for venting gas from such explosive expansion through the gas flow passage.

6. A method for attenuating airblast produced by explosively expanding a portion of subterranean formation containing oil shale for forming an in situ oil shale retort containing a fragmented permeable mass of formation particles containing oil shale, the method comprising the steps of:

excavating means for access to the retort site in the formation containing oil shale;

boring at least one gas flow passage through a barrier of unfragmented formation between the means for access and the retort site;

excavating at least one void in a portion of the retort site via access provided by the gas flow passage, the gas flow passage providing gas communication between the means for access and the void, the gas flow passage having a transverse cross-section which is substantially smaller than the transverse cross-section of the means for access;

placing explosive in a remaining portion of unfragmented formation within the retort site adjacent the void;

detonating such explosive for explosively expanding the remaining portion of unfragmented formation toward such a void for forming an in situ oil shale retort containing a fragmented permeable mass of formation particles containing oil shale; and leaving such a gas flow passage open during such explosive expansion for temporarily confining gas from such explosive expansion via the smaller cross-section of such a passage and for venting gas from such explosive expansion to the means for access via such a passage for attenuating airblast in the means for access.

7. A method for attenuating airblast produced by detonating explosive in a subterranean formation containing oil shale for forming an in situ retort containing a fragmented permeable mass of formation particles containing oil shale, the method comprising the steps of:

excavating a means for access to an upper portion of a retort site within such a formation containing oil shale;

boring at least one gas flow passage from the means for access to formation containing oil shale within the retort site, the transverse cross-sectional area of such a gas flow passage being substantially smaller than the transverse cross-sectional area of the means for access;

excavating at least one columnar void within the retort site below the means for access via access provided by such a gas flow passage, leaving a sill pillar of unfragmented formation between the means for access and such a void, the passage extending through the sill pillar between the means for access and the void, and leaving a remaining portion of unfragmented formation within the retort site adjacent such a void, the columnar void having a height similar to that of the retort being formed;

placing explosive in such a remaining portion of unfragmented formation;

explosively expanding such a remaining portion of unfragmented formation toward such a void by detonating such explosive in a single round of explosions for forming an in situ retort containing a fragmented permeable mass of formation particles containing oil shale; and leaving such a gas flow passage open during the explosive expansion step so that the smaller cross-section of the passage temporarily confines gas from such explosive expansion and vents gas from such explosive expansion to the means for access for attenuating airblast in the means for access.

8. The method according to claim 7 in which the transverse cross-section of the gas flow passage is substantially smaller than that of the columnar void.

9. The method according to claim 7 in which the means for access is in gas communication with underground workings extending to daylight.

10. In a method for forming an in situ oil shale retort in a subterreanean formation containing oil shale in which a means for access is excavated to a retort site in the formation containing oil shale, and at least one void is excavated in formation within the retort site, leaving a remaining portion of unfragmented formation within the retort site adjacent the void, and in which explosive is placed in such a portion of unfragmented formation and detonated in a single round of explosions to explosively expand such a portion of unfragmented formation toward such a void for forming an in situ oil shale retort containing a fragmented permeable mass of formation particles containing oil shale, the improvement comprising the steps of:

leaving a wall of unfragmented formation between such a void and the means for access;

providing a gas flow passage through the wall of unfragmented formation between the retort site and the means for access, the transverse cross-sectional area of the gas flow passage being substantially smaller than that of the means for access; and confining gas from such explosive expansion and limiting flow of such gas from the retort site by means of the smaller cross-section of such a gas flow passage so as to attenuate airblast in the means for access.

11. The improvement according to claim 10 in which the passage provides a cross-section for gas flow which is substantially smaller in the transverse cross-section than means for access extending from adjacent the retort site to daylight.

12. A method for attenuating airblast produced by detonating explosive in a subterranean formation containing oil shale for forming a fragmented permeable mass of formation particles containing oil shale in an in situ oil shale retort, the method comprising the steps of:

excavating underground workings for providing a means for access to a retort site in the formation containing oil shale;

excavating at least one void in formation within the retort site, leaving a remaining portion of unfragmented formation within the retort site adjacent such a void, and leaving a barrier of unfragmented formation between the underground workings and the retort site;

providing at least one gas flow passage extending through the barrier of unfragmented formation between the underground workings and the retort site, the gas flow passage having a cross section for gas flow which is sufficiently smaller than the transverse cross section of the underground workings to temporarily confine gas from an explosion in the retort site and vent gas from such an explosion sufficiently slowly to attenuate airblast in the underground workings;

placing explosive in the remaining portion of unfragmented formation within the retort site adjacent such a void;

detonating the explosive for explosively expanding the portion of unfragmented formation toward such a void for forming a fragmented permeable mass of formation particles containing oil shale in an in situ oil shale retort; and venting at least a portion of the gas from such explosive expansion from the retort site through the gas flow passage toward the underground workings for limiting the rate of flow of such gas to the underground workings by means of the smaller cross section of the flow passage so as to attenuate airblast in the underground workings.

13. The method according to claim 12 including forming the gas flow passage with a cross section for gas flow which is sufficiently smaller than the transverse cross-sectional area of underground workings providing a means for access between the retort site and daylight to avoid injury to personnel or damage to equipment in underground workings.

14. A method for attenuating airblast produced by detonating explosive in a subterranean formation containing oil shale for forming an in situ oil shale retort containing a fragmented permeable mass of formation particles containing oil shale, the method comprising the steps of:

excavating a means for access to an upper portion of a retort site within the formation containing oil shale;

excavating at least one columnar void within the retort site below the means for access, such a columnar void having a height similar to that of the retort being formed, leaving a remaining portion of unfragmented formation within the retort site adjacent such a void, and leaving a sill pillar of unfragmented formation between the means for access and such a void;

providing at least one gas flow passage through the sill pillar between the means for access and the top of the columnar void, the gas flow passage having a cross section for gas flow which is smaller than the transverse cross section of the means for access and also smaller than the transverse cross section of the void;

placing explosive in the remaining portion of unfragmented formation within the retort site; and explosively expanding such a portion of unfragmented formation toward the columnar void by detonating such explosive in a single round for forming an in situ oil shale retort containing a fragmented permeable mass of formation particles containing oil shale, such a gas flow passage having a sufficiently small cross section for gas flow for temporarily confining gas from such explosive expansion and for venting gas from such explosive expansion to the means for access for attenuating airblast in such means for access.

15. The method according to claim 14 including forming the void, at least in part, via access provided by the gas flow passage, and leaving the gas flow passage open during the explosive expansion step for venting gas from such explosive expansion through the gas flow passage.

16. A method for attenuating airblast produced by explosively expanding a portion of subterranean formation containing oil shale for forming an in situ oil shale retort containing a fragmented permeable mass of formation particles containing oil shale, the method comprising the steps of:

excavating means for access to the retort site in the formation containing oil shale;

boring at least one gas flow passage through a barrier of unfragmented formation between the means for access and the retort site;

excavating at least one void in a portion of the retort site via access provided by the gas flow passage, the gas flow passage providing gas communication between the means for access and the void, the gas flow passage having a transverse cross section which is sufficiently smaller than the transverse cross section of the means for access for temporarily confining gas from an explosion in the retort site and for venting gas from such an explosion to the means for access for attenuating airblast in the means for access;

placing explosive in a remaining portion of unfragmented formation within the retort site adjacent the void;

detonating such explosive for explosively expanding the remaining portion of unfragmented formation toward such a void for forming an in situ oil shale retort containing a fragmented permeable mass of formation particles containing oil shale; and leaving such a gas flow passage open during such explosive expansion for temporarily confining gas from such explosive expansion via the smaller cross section of such a passage and for venting gas from such explosive expansion to the means for access via such a passage for attenuating airblast in the means for access.

17. A method for attenuating airblast produced by detonating explosive in a subterranean formation containing oil shale for forming an in situ retort containing a fragmented permeable mass of formation particles containing oil shale, the method comprising the steps of:

excavating a means for access to an upper portion of a retort site within such a formation containing oil shale;

boring at least one gas flow passage from the means for access to formation containing oil shale within the retort site, the transverse cross-sectional area of such a gas flow passage being smaller than the transverse cross-sectional area of the means for access;

excavating at least one columnar void within the retort site below the means for access via access provided by such a gas flow passage, leaving a sill pillar of unfragmented formation between the means for access and such a void, the passage extending through the sill pillar between the means for access and the void, and leaving a remaining portion of unfragmented formation within the retort site adjacent such a void, the columnar void having a height similar to that of the retort being formed;

placing explosive in such a remaining portion of unfragmented formation;

explosively expanding such a remaining portion of unfragmented formation toward such a void by detonating such explosive in a single round of explosions for forming an in situ retort containing a fragmented permeable mass of formation particles containing oil shale; and leaving such a gas flow passage open during the explosive expansion step so that the smaller cross section of the passage temporarily confines gas from such explosive expansion and vents gas from such explosive expansion to the means for access for attenuating airblast in the means for access.

18. The method according to claim 17 in which the transverse cross section of the gas flow passage is sufficiently smaller than the cross section of the means for access available for gas flow to avoid injury to personnel or damage to equipment in underground workings between the means for access and daylight.

19. The method according to claim 17 in which the transverse cross section of the gas flow passage is substantially smaller than that of the columnar void.

20. In a method for forming an in situ oil shale retort in a subterranean formation containing oil shale in which a means for access is excavated to a retort site in the formation containing oil shale, and at least one void is excavated in formation within the retort site, leaving a remaining portion of unfragmented formation within the retort site adjacent the void, and in which explosive is placed in such a portion of unfragmented formation and detonated in a single round of explosions to explosively expand such a portion of unfragmented formation toward such a void for forming an in situ oil shale retort containing a fragmented permeable mass of formation particles containing oil shale, the improvement comprising the steps of:

leaving a barrier of unfragmented formation between such a void and the means for access; and providing a gas flow passage through the wall of unfragmented formation between the retort site and the means for access, the transverse cross-sectional area of the gas flow passage being sufficiently smaller than that of the means for access for confining gas from such explosive expansion and limiting flow of such gas from the retort site by means of the smaller cross section of such a gas flow passage so as to attenuate airblast in the means for access.

21. The improvement according to claim 20 in which the passage provides a cross section for gas flow which is sufficiently smaller in the transverse cross section than means for access extending from adjacent the retort site to daylight to avoid injury to personnel or damage to equipment in such means for access.

* * * * *

UNITED STATES PATENT AND TRADEMARK OFFICE

CERTIFICATE OF CORRECTION

PATENT NO. : 4,201,419

DATED : May 6, 1980

INVENTOR(S) : Ned M. Hutchins

It is certified that error appears in the above-identified patent and that said Letters Patent are hereby corrected as shown below:

Please add the following language as the first paragraph under the heading "Background of the Invention".

-- The Government has rights in this invention pursuant to Contract No. DE-FC20-78-LC10036 (formerly EF-77-A-04-3873) awarded by the U.S. Department of Energy. --

Signed and Sealed this

Ninth Day of August 1983

[SEAL]

*Attest:*

GERALD J. MOSSINGHOFF

*Attesting Officer*

*Commissioner of Patents and Trademarks*